US008795141B2

(12) United States Patent
Huang

(10) Patent No.: US 8,795,141 B2
(45) Date of Patent: Aug. 5, 2014

(54) COMPOSITE CHAIR STORAGE DEVICE

(75) Inventor: Wan-Fu Huang, Minxiong Township, Chiayi County (TW)

(73) Assignee: Fitness Products Inc., Minxiong Township, Chiayi County (TW)

( * ) Notice: Subject to any disclaimer, the term of this patent is extended or adjusted under 35 U.S.C. 154(b) by 157 days.

(21) Appl. No.: 13/493,231

(22) Filed: Jun. 11, 2012

(65) Prior Publication Data

US 2013/0331237 A1 Dec. 12, 2013

(51) Int. Cl.

| | |
|---|---|
| ***A63B 22/00*** | (2006.01) |
| ***A63B 22/06*** | (2006.01) |
| ***A63B 69/16*** | (2006.01) |
| ***A63B 71/00*** | (2006.01) |
| ***A63B 26/00*** | (2006.01) |

(52) U.S. Cl.

USPC ..... 482/57; 142/51; 142/142

(58) Field of Classification Search

CPC ..... A63B 22/0605; A63B 2210/02; A63B 2208/0233; A63B 2022/0652; A63B 2021/1609; A63B 23/00; A63B 23/0476

USPC ..... 482/130, 57, 142; 297/423.19, 423.2; 601/24, 115, 27, 32, 36

See application file for complete search history.

(56) References Cited

U.S. PATENT DOCUMENTS

| | | | | |
|---|---|---|---|---|
| 3,738,649 | A * | 6/1973 | Miller | 482/57 |
| 3,968,963 | A * | 7/1976 | Sileo | 482/57 |
| 4,262,902 | A * | 4/1981 | Dranselka | 482/60 |
| 4,805,901 | A * | 2/1989 | Kulick | 482/63 |
| 4,921,247 | A * | 5/1990 | Sterling | 482/138 |
| 5,470,298 | A * | 11/1995 | Curtis | 482/130 |

* cited by examiner

*Primary Examiner* — Oren Ginsberg
*Assistant Examiner* — Rae Fischer
(74) *Attorney, Agent, or Firm* — Alan Kamrath; Kamrath IP Lawfirm, P.A.

(57) ABSTRACT

A composite chair storage device includes a chair, a slide mechanism and an exercise module for storing a composite chair. A first roller and a second roller are embedded into two slide rails for performing linear displacement. With the assistance of a sliding third roller and a pressure element capable of turning over an exercise equipment of an exercise module, the exercise module can be stored into a containing space of the chair or unfolded from the containing space of the chair quickly and conveniently, to achieve the effect of folding and unfolding the composite chair effectively.

6 Claims, 5 Drawing Sheets

COMPOSITE CHAIR STORAGE DEVICE

BACKGROUND OF THE INVENTION

1. Field of the Invention

The present invention relates to a composite chair storage device and, more particularly, to the storage device capable of turning an exercise module upside down to facilitate its storage into a containing space of a chair.

2. Description of the Prior Art

In general, conventional massage sofas emphasize the functions of massage and leg rest storage, and a complicated structure with link rods and an additional power supply are required to achieve the effect of storing the leg rest.

However, the aforementioned conventional massage sofa has the following drawbacks:

1. The conventional massage sofa only provides a simple massage function, and thus having a limited scope of applicability and a low commercial value.

2. The conventional massage sofa requires an additional power supply, and thus is not compliant with the energy saving and carbon reduction requirements.

Even though the aforementioned conventional massage sofa can meet the basic functional requirements of providing simulated massages and leg rests, it cannot meet the environmental protection and durability requirements due to its complicated structure and components and an additionally required power supply and fails to improve the industrial effects or to serve as a widely-used composite chair storage device.

SUMMARY OF THE INVENTION

It is a primary objective of the present invention to provide a composite chair storage device with a simple structural design while taking the capability of carrying a load into consideration. In addition to the effects of providing diversified applications to improve the mechanism of using and the flexibility of storage, and of providing basic loading power to facilitate users to fold and unfold a leg rest or an exercise module easily in a heavy load condition, the composite chair storage device further comes with an enhanced structural design and a user-friendly and convenient folding/unfolding operation to meet user requirements and gain commercial benefits.

To achieve the foregoing objective, the present invention provides a composite chair storage device comprising a chair, a slide mechanism and an exercise module. More specifically, the technical measures and solutions taken by the invention are described below.

The chair has a containing space.

The slide mechanism is installed in the containing space of the chair and includes a main rod, a first transverse rod, a second transverse rod and two slide rails. The first transverse rod and the second transverse rod are installed perpendicularly to the main rod. A first roller and a second roller are installed on both sides of the first transverse rod and the second transverse rod respectively, and the first roller and the second roller are embedded into the slide rails for linear displacement.

The exercise module can be selectively folded into the containing space and unfolded from the containing space. The exercise module includes a sleeve rod, an exercise equipment and a pressure element. The sleeve rod is sheathed on the main rod of the slide mechanism, and both sides of the pressure element are respectively and pivotally installed to the sleeve rod and the exercise equipment.

The sleeve rod of the exercise module further includes two third rollers installed on the sleeve rod.

The exercise equipment of the exercise module further includes a support-rod base.

The exercise equipment of the exercise module is a fitness bicycle or a weight training device.

The pressure element is a hydraulic cylinder or a pneumatic cylinder.

The composite chair storage device of the present invention has the following advantages and features:

1. The invention features a simple structure with less components and an easy installation that saves time.

2. The invention provides a device to assist users to fold and unfold an exercise module, to improve the overall operating smoothness.

3. The invention has diversified exercise functions, and thus providing a large scope of applicability and gaining a high commercial value.

4. The invention does not require any additional power supply, and thus is in compliance with the energy saving and carbon reduction requirements.

5. The invention provides a convenient and user-friendly folding/unfolding operation, and thus providing high commercial benefits.

6. The folded chair has an appearance of an integral structure, and, thus, the invention is both functional and aesthetic.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
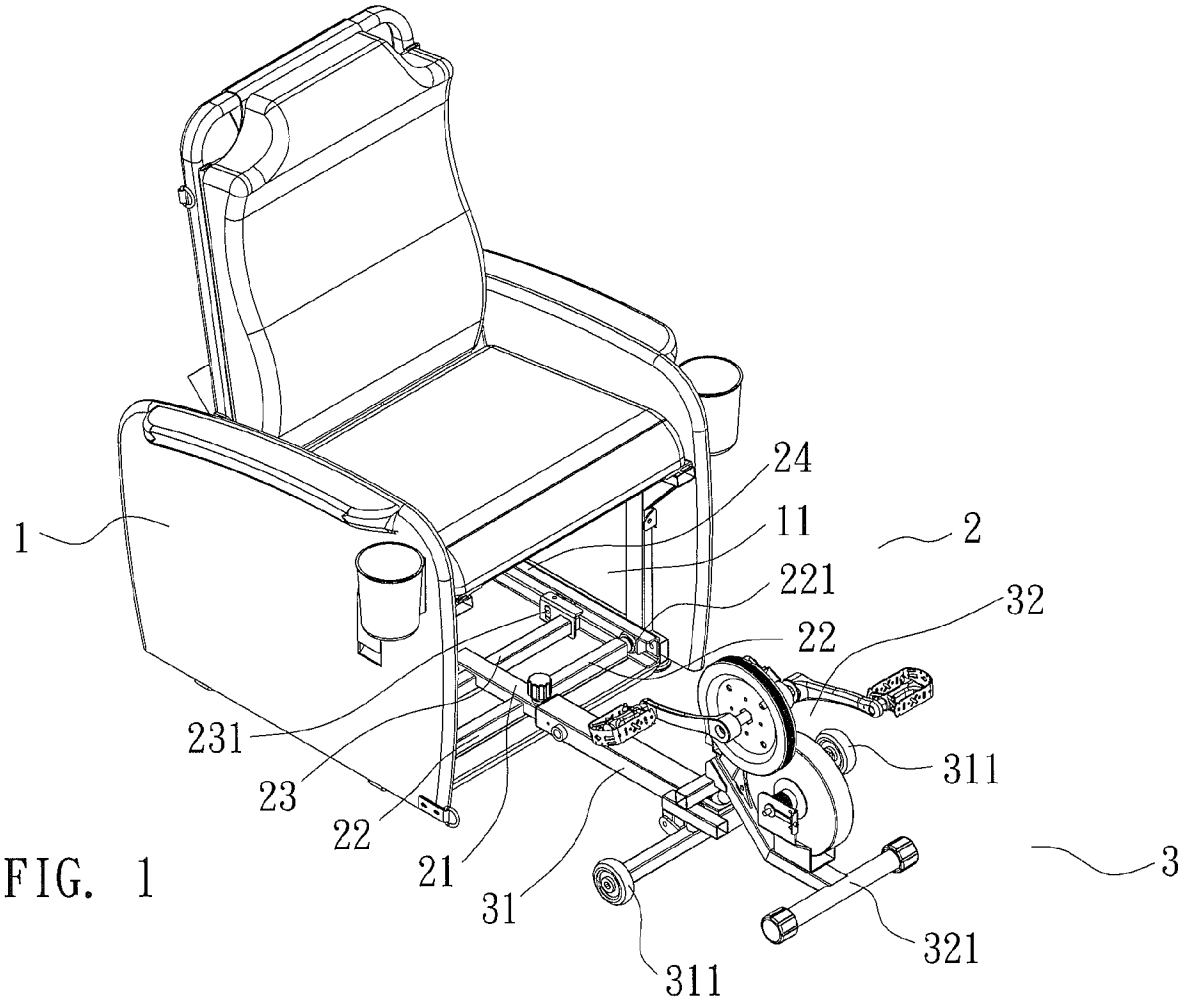
FIG. 1 is a perspective view of an unfolded status of the whole device of a preferred embodiment of the present invention.
Figure 3:
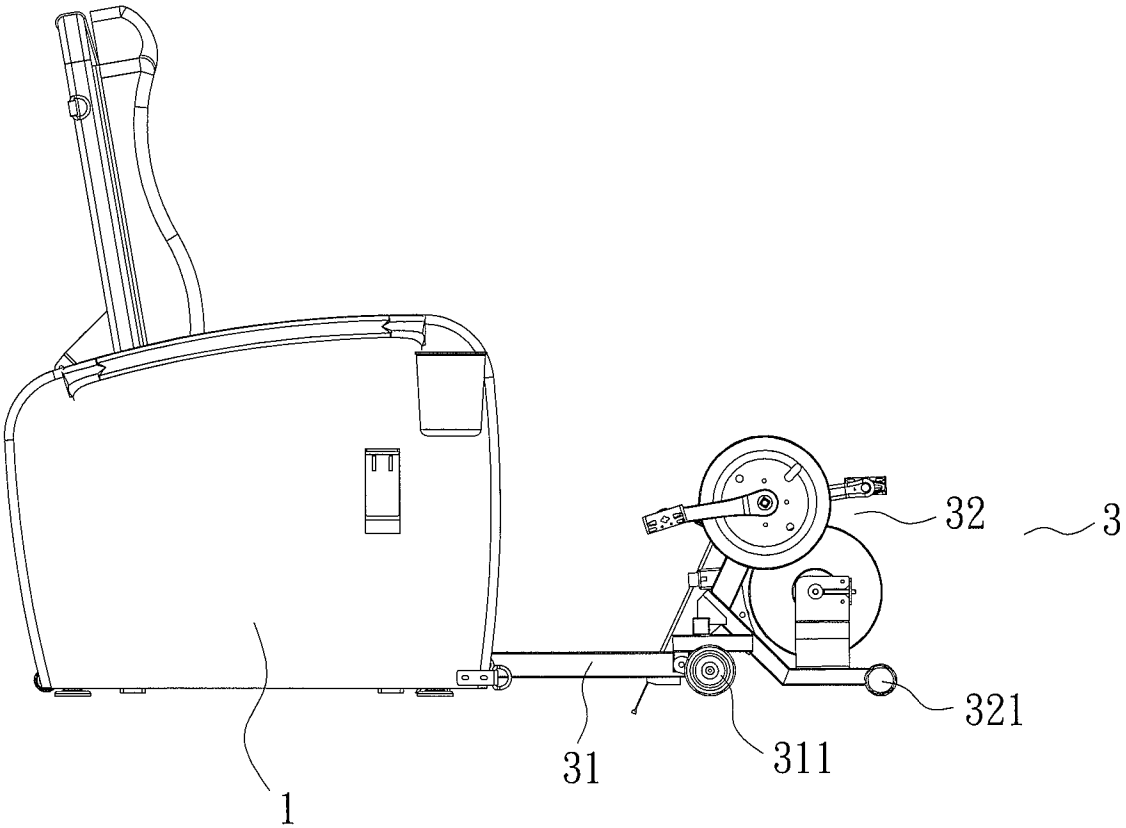
FIG. 3 is a side view of an unfolded status of the whole device of a preferred embodiment of the present invention.

With reference to FIGS. 1 and 3, a composite chair storage device of the present invention comprises a chair 1, a slide mechanism 2 and an exercise module 3.

The chair 1 has a containing space 11.

The slide mechanism 2 is installed in the containing space 11 of the chair 1, and includes a main rod 21, a first transverse rod 22, a second transverse rod 23 and two slide rails 24. The first transverse rod 22 and the second transverse rod 23 are installed perpendicularly to the main rod 21. A first roller 221 and a second roller 231 are installed on both sides of the first transverse rod 22 and the second transverse rod 23 respectively, and the first roller 221 and second roller 231 are embedded into the slide rails 24 for performing linear displacement.

Figure 5:
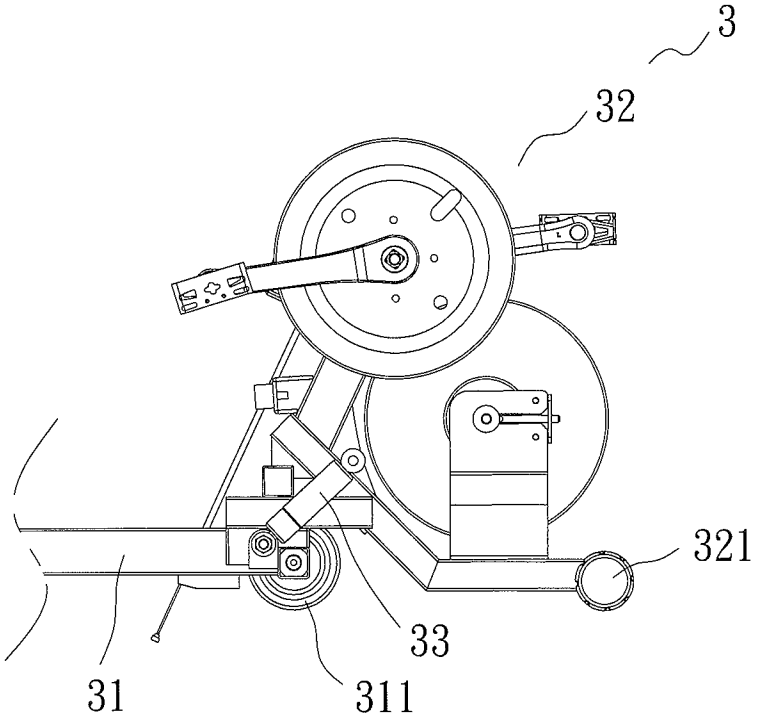
FIG. 5 is a side view of a horizontally unfolded status of an exercise module in accordance with a preferred embodiment of the present invention.

The exercise module 3 can be selectively folded into the containing space 11 and unfolded from the containing space 11. The exercise module 3 includes a sleeve rod 31, an exercise equipment 32 and a pressure element 33. The sleeve rod 31 is sheathed on the main rod 21 of the slide mechanism 2, and both sides of the pressure element 33 (as shown in FIG. 5) are respectively and pivotally installed to the sleeve rod 31 and the exercise equipment 32.

The sleeve rod 31 of the exercise module 3 further includes two third rollers 311. The exercise equipment 32 further includes a support-rod base 321. The exercise equipment 32 is a fitness bicycle or a weight training device, and the pressure element 33 is a hydraulic cylinder or a pneumatic cylinder.

The exercise module 3 is disposed in the containing space 11 of the chair as shown in the figure, and the exercise module 3 also can use the third roller 311 and the support-rod base 321 as the main support structures. The first roller 221 and the second roller 231 are embedded into the slide rails 24 respectively to constitute a secondary support structure. In a horizontal unfolded status as shown in FIG. 5, the pressure element 33 (which is a hydraulic cylinder or a pneumatic cylinder) is situated at the maximum compressed stroke to further provide additional stability of the exercise module 3.

Figure 2:
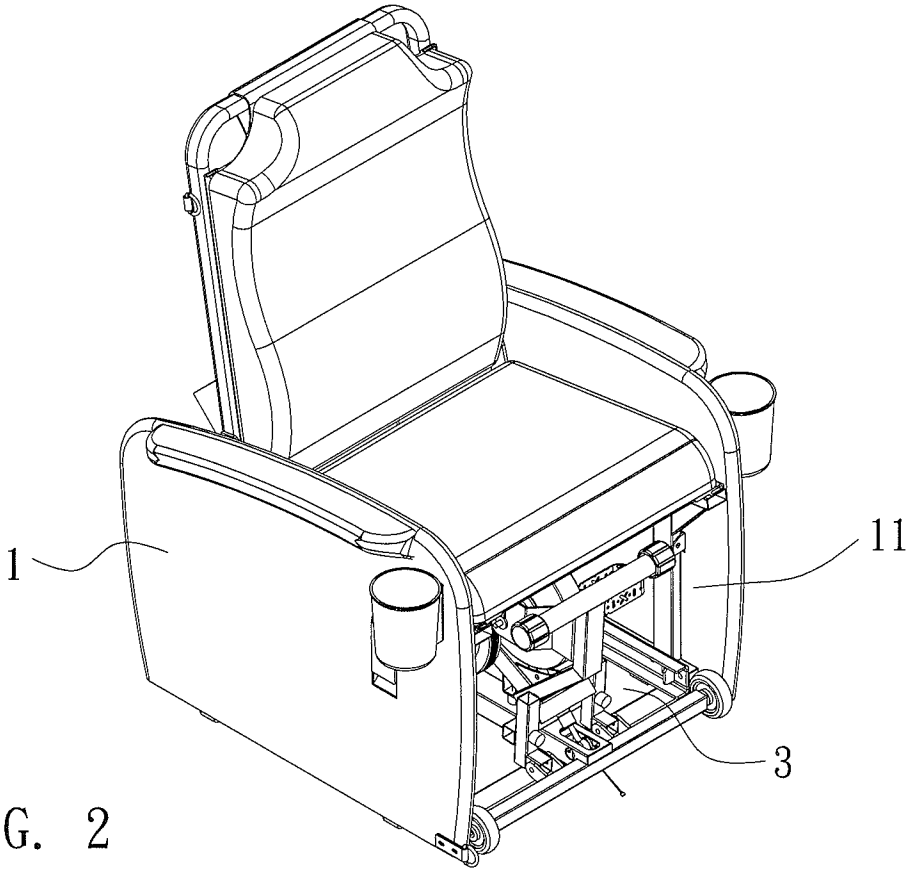
FIG. 2 is a perspective view of a folded status of the whole device of a preferred embodiment of the present invention.
Figure 4:
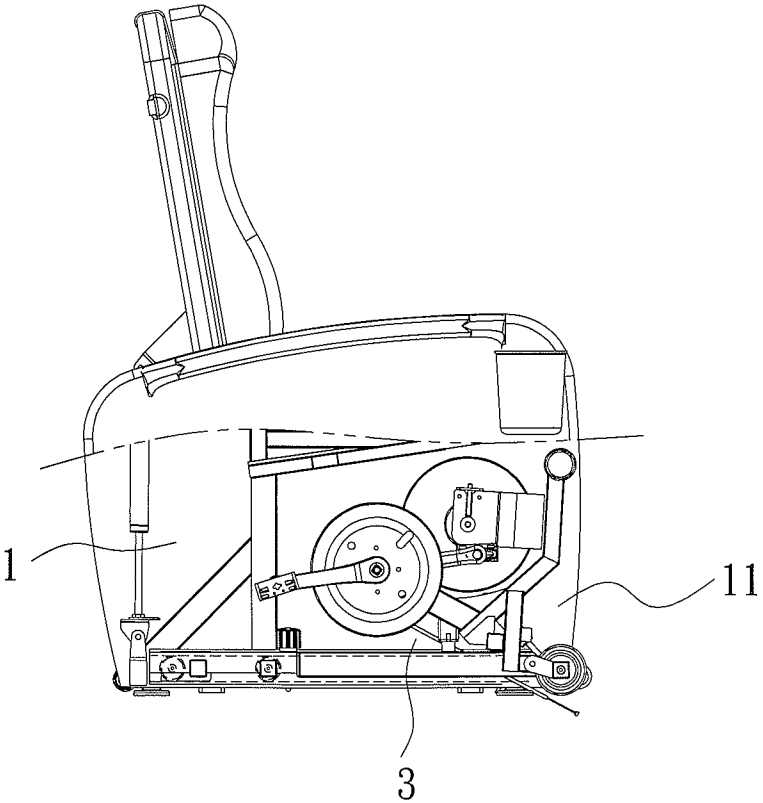
FIG. 4 is a side view of a folded status of the whole device of a preferred embodiment of the present invention.
Figure 6:
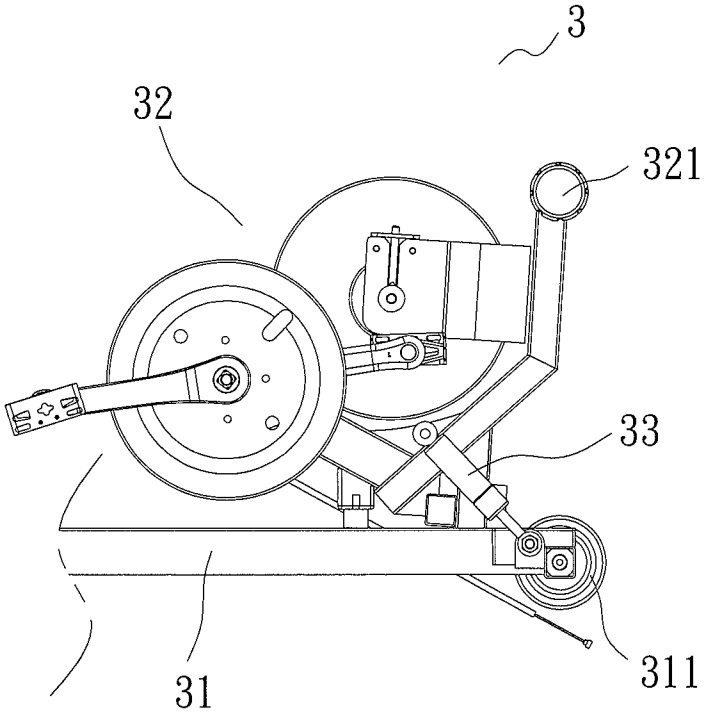
FIG. 6 is a side view of a folded status of an exercise module in accordance with a preferred embodiment of the present invention.

With reference to FIGS. 1, 3 and 6, when the exercise equipment 32 of the exercise module 3 is not in use, and when the exercise equipment 32 is stored as shown in FIGS. 2 and 4, it is necessary to turn the exercise module 3 upside down to set the exercise module in a folded status (as shown in FIG. 6) before the exercise module 3 can be stored into the containing space 11 of the chair 1 (as shown in FIG. 1). In the process of turning the exercise module 3 upside down and folding the exercise module 3, the pivoting position of the pressure element 33 and the sleeve rod 31 is used as a hinge to turn the exercise module 3 upward. Then, the exercise module 3 is turned to an angle approximately equal to 90 degrees, so that the exercise module 3 is attached onto the sleeve rod 31 to obtain the minimum height, the support-rod base 321 leaves the ground, and only the third roller 311 is in contact with the ground. Now, the pressure element 33 (which is a hydraulic cylinder or a pneumatic cylinder) is situated at the maximum stretching stroke condition to further provide additional stability of supporting the exercise module 3.

When the exercise module 3 is pushed to move towards the containing space 11 of the chair 1, the first roller 221 and the second roller 231 are embedded into the slide rails 24 to allow a slide movement. Thus, the exercise module 3 can enter into the containing space 11 of chair 1 completely with the assistance of the sliding third roller 311, to achieve the storing effect as shown in FIGS. 2 and 4. The stored exercise module 3 is completely hidden into the containing space 11 of the chair 1 to become a whole piece with the chair 1. Thus, the invention provides both functional and aesthetic effects.

If it is necessary to use the exercise module 3 again, the steps of the aforementioned procedure are reversed. In other words, the exercise module 3 is pulled out to a fixed position from the containing space 11 of the chair 1 as shown in FIG. 6, and then turned downward to an angle approximately equal to 90 degrees. Thus, the third roller 311 and the support-rod base 321 are in contact with the ground stably. Now, the unfolding is completed as shown in FIG. 5.

In summation of the description above, the present invention provides a composite chair storage device comprising the chair 1, the slide mechanism 2 and the exercise module 3 for storing a composite chair. The first roller 221 and the second roller 231 are embedded into the slide rails 24 for performing a linear displacement. With the assistance of the sliding third roller 311 and the pressure element 33 capable of turning over the exercise equipment 32 of the exercise module 3, the exercise module 3 can be stored into the containing space 11 of the chair 1 or unfolded from the containing space 11 of the chair 1 quickly and conveniently. Therefore, the composite chair can be folded or unfolded effectively.

While various embodiments in accordance with the present invention have been shown and described, it is clear to those skilled in the art that further embodiments may be made without departing from the scope of the present invention.

What is claimed is:

1. A composite chair storage device comprising:

a chair having a containing space;

a slide mechanism, installed in the containing space of the chair, and including a main rod, a first transverse rod, a second transverse rod and two slide rails, with the first transverse rod and the second transverse rod installed perpendicularly to the main rod;

a first roller and a second roller installed on both sides of the first transverse rod and the second transverse rod respectively, with the first roller and the second roller embedded into a slide rail and provided for performing linear displacement; and an exercise module selectively folded into the containing space and unfolded from the containing space, with the exercise module including a sleeve rod, an exercise equipment and a pressure element, with the sleeve rod sheathed on the main rod of slide mechanism, and with both sides of the pressure element respectively and pivotally installed to the sleeve rod and the exercise equipment.

2. The composite chair storage device as recited in claim 1, wherein the sleeve rod of the exercise module further includes two third rollers installed thereon.

3. The composite chair storage device as recited in claim 1, wherein the exercise equipment of the exercise module includes a support-rod base installed thereto.

4. The composite chair storage device as recited in claim 1, wherein the exercise equipment of the exercise module is a fitness bicycle.

5. The composite chair storage device as recited in claim 1, wherein the pressure element is a hydraulic cylinder.

6. The composite chair storage device as recited in claim 1, wherein the pressure element is a pneumatic cylinder.

* * * * *